US011034503B1

(12) United States Patent
Lee

(10) Patent No.: US 11,034,503 B1
(45) Date of Patent: Jun. 15, 2021

(54) CONTAINER FOR MIXING HETEROGENEOUS CONTENTS

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 0 days.

(21) Appl. No.: 17/014,793

(22) Filed: Sep. 8, 2020

(51) Int. Cl.
*B65D 81/32* (2006.01)
*B05B 11/00* (2006.01)
*A45D 40/24* (2006.01)

(52) U.S. Cl.
CPC ..... *B65D 81/3222* (2013.01); *A45D 40/24* (2013.01); *B05B 11/3084* (2013.01); *B65D 81/3255* (2013.01); *A45D 2200/056* (2013.01); *B05B 11/3001* (2013.01)

(58) Field of Classification Search
CPC ..... B65D 81/3222; B65D 81/3255; B05B 11/3084; B05B 11/3001; A45D 40/24; A45D 2200/056
See application file for complete search history.

(56) References Cited

U.S. PATENT DOCUMENTS 5,411,176 A * 5/1995 Favre ..... B05B 11/0005 222/94
6,305,578 B1 * 10/2001 Hildebrandt ..... B01F 5/0403 222/135
6,454,135 B1 * 9/2002 Brozell ..... B05B 11/3011 222/135
7,137,531 B2 * 11/2006 Arghyris ..... B05B 11/3023 222/94
8,608,029 B2 * 12/2013 Lee ..... B01F 13/002 222/135
9,162,241 B2 * 10/2015 Holzmann ..... B05B 11/0081
9,579,673 B2 * 2/2017 Burrowes ..... B05B 11/0038
9,693,619 B2 * 7/2017 Ki ..... A45D 40/24
9,925,550 B2 * 3/2018 Dring ..... B05B 11/3001
10,583,450 B2 * 3/2020 Brugger ..... B05B 11/3073
(Continued)

FOREIGN PATENT DOCUMENTS

KR 200390095 Y1 7/2005
KR 101923306 B1 10/2018

*Primary Examiner* — Frederick C Nicolas
(74) *Attorney, Agent, or Firm* — Heedong Chae; Lucem, PC

(57) ABSTRACT

The container includes a first container formed therein with a content storage space and a container coupling space that are separately defined, a second container coupled to the container coupling space of the first container, a first discharge device installed in the first container to discharge contents stored in the first container, a second discharge device installed in the second container to discharge contents stored in the second container, and a push button configured to simultaneously actuate the first and second discharge devices and formed with first and second discharge passages connected to the first and second discharge devices, respectively, and first and second discharge ports. The second container is inserted into an opened lower portion of the container coupling space so that the second container is coupled with the first container, and the second discharge device installed in the second container is connected to the second discharge passage.

6 Claims, 7 Drawing Sheets

(56) References Cited

U.S. PATENT DOCUMENTS

| | | | | |
|---|---|---|---|---|
| RE48,427 | E * | 2/2021 | Bruder | B05B 11/3084 |
| 2019/0357656 | A1* | 11/2019 | Kang | A45D 19/022 |
| 2019/0366370 | A1* | 12/2019 | Kang | A45D 34/06 |
| 2020/0054114 | A1* | 2/2020 | Kang | A45D 33/26 |

* cited by examiner

CONTAINER FOR MIXING HETEROGENEOUS CONTENTS

BACKGROUND

1. Field of the Invention

One aspect of the present disclosure relates to a container for mixing heterogeneous contents, and more particularly, to a container for mixing heterogeneous contents in which a second container is coupled to a lower portion of a container coupling space of a first container, and a discharge device and a discharge passage of the second container are connected to each other through a sealing member formed of a soft material, so that the first and second containers can be easily coupled to each other, contents can be prevented from being contaminated due to external foreign substances during the coupling process, and the second container can be stably maintained in a sealed state.

2. Description of the Related Art

In general, there are many cases where two or more different contents are mixed and used in order to multiply the efficacy or effect of cosmetics or medicines contained in a container.

However, after the contents are mixed and then the mixed contents are contained in a single container, when the mixed contents are distributed or stored, a chemical reaction may occur in the container while causing the mixed contents to be coagulated or precipitated, so that a discharge error may occur or the mixed contents may be discolored or deteriorated.

Thus, according to the related art, after different contents are stored in separate containers, respectively, the contents are individually discharged and mixed directly when used by a user or the different contents are stored in separate containers. Then, the contents are used after inlets of the two containers are opened and the contents are mixed in a separate container. However, according to the above-described method, the user is required to directly mix and use the contents stored in a separate container, so the risk of loss increases and the portability decreases.

Therefore, in recent years, a container for mixing heterogeneous materials has been developed such that different contents may be mixed and used according to the manipulation of a user when necessary, where the different contents are stored in a single container while being isolated from each other.

As the related art, Korean Patent Registration No. 10-1923306 discloses a heterogeneous material mixing container. According to the above related art, an inner container is inserted into an outer container, each of the container is equipped with one of pump sets, and mutually different cosmetics are stored in the outer container and the inner container, respectively, so that the different kinds of cosmetic contents can be simultaneously discharged, mixed and used once a pumping is performed.

However, since the related art has a structure in which the inner container is accommodated together with the cosmetic contents stored in the outer container, external foreign substances placed on an outer periphery of the inner container enter an inside of the outer container in the process of assembling or disassembling the inner container into or from the outer container, and thus the cosmetic contents stored in the outer container are contaminated.

In addition, according to the related art, when the outer container and the inner container containing mutually different contents are packed separately and then assembled and used by a purchaser, the entire container is inserted into an inlet portion of the opened outer container and thus the contents stored in the outer container overflow to the outside due to the volume or sudden insertion of the inner container, thereby contaminating the surroundings, and interrupting the assembling work.

DOCUMENTS OF RELATED ART

Patent Documents

Korean Utility Model Registration No. 20-0390095 (issued on Jul. 18, 2005) entitled as"ESSENCE COSMETIC CASE FOR MIXING POWDER"

Korean Patent Registration No. 10-1923306 (issued on Nov. 28, 2018) entitled as"HETEROGENEOUS MATERIAL MIXING CONTAINER"

SUMMARY

One aspect of the present disclosure provides a container for mixing heterogeneous contents, wherein first and second containers for storing mutually different contents are connected to first and second discharge devices, respectively, to allow the heterogeneous contents to be discharged to the outside at once by a press action of a push button, in which a second container is coupled to a lower portion of a container coupling space of a first container, and a discharge device formed in the second container and a discharge passage formed in a push button are connected to each other as the first container is coupled to the second container, so that the first and second containers can be easily coupled to each other, and contents can be prevented from being contaminated due to external foreign substances during the coupling process.

In addition, one aspect of the present disclosure provides a container for mixing heterogeneous contents, wherein a first discharge passage connected to a first discharge device of the first container and a second discharge passage connected to a second discharge device of the second container are formed inside the push button, and a soft sealing member is formed at the end of the second discharge passage, so that the sealing member and the second discharge device can be assembled with each other as the second container is coupled to the first container, thereby stably maintaining the second container in a sealed state.

One aspect of the present disclosure provides a container for mixing heterogeneous contents, the container including: a first container formed therein with a content storage space and a container coupling space that are separately defined; a second container coupled to the container coupling space of the first container; a first discharge device installed in the first container to discharge contents stored in the first container; a second discharge device installed in the second container to discharge contents stored in the second container; and a push button configured to simultaneously actuate the first and second discharge devices and formed with first and second discharge passages connected to the first and second discharge devices, respectively, and first and second discharge ports, wherein the second container is inserted into an opened lower portion of the container coupling space so that the second container is coupled with the first container, and the second discharge device installed in the second container is connected to the second discharge passage.

In addition, the container may further include a cap member provided at an inner side thereof with a support plate and coupled to the first container, wherein the support plate may be formed with a discharge device installation hole to install the first discharge device and a discharge device through hole in which the second discharge device passes through the discharge device through hole.

In addition, the second container may be biased to one side from a center of the first container.

Further, the first and second discharge devices may include pumps for discharging the contents to an outside by pumping.

In addition, a soft sealing member may be formed at an end of the second discharge passage of the push button, and the second discharge device installed in the second container may be fitted with the soft sealing member when the first container is coupled with the second container.

Further, the soft sealing member may include a coupling portion coupled to the second discharge passage and a sealing insert portion inserted into a second stem of the second discharge device.

According to one aspect of the present disclosure, first and second containers for storing mutually different contents are connected to first and second discharge devices, respectively, to allow the heterogeneous contents to be discharged to the outside at once by a press action of a push button, in which a second container is coupled to a lower portion of a container coupling space of a first container, and a discharge device formed in the second container and a discharge passage formed in a push button are connected to each other as the first container is coupled to the second container, so that the first and second containers can be easily coupled to each other, and contents can be prevented from being contaminated due to external foreign substances during the coupling process.

In addition, according to one aspect of the present disclosure, a first discharge passage connected to a first discharge device of the first container and a second discharge passage connected to a second discharge device of the second container are formed inside the push button, and a soft sealing member is formed at the end of the second discharge passage, so that the sealing member and the second discharge device can be assembled with each other as the second container is coupled to the first container, thereby stably maintaining the second container in a sealed state.

DETAILED DESCRIPTION OF THE EMBODIMENTS

Figure 1:
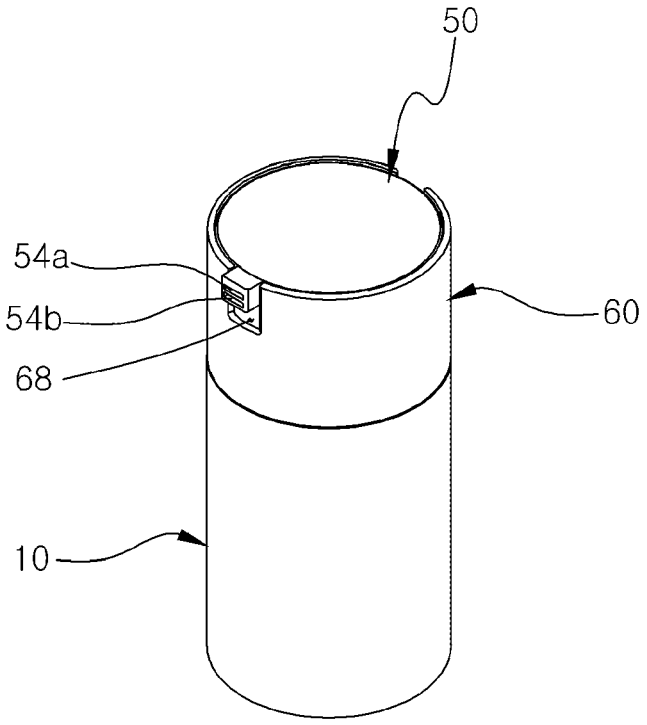
FIG. 1 is a perspective view of a mixing container according to one aspect of the present disclosure.

Hereinafter, the detailed descriptions of one aspect of the present disclosure are embodiments for carrying out one aspect of the present disclosure, and the corresponding embodiment refers to the accompanying drawings as an example. The embodiments will be described in detail to enable those skilled in the art to carry out one aspect of the present disclosure. It is apparent to be understood that the various embodiments of one aspect of the present disclosure may be different from each other but do not need to be mutually exclusive. For example, the particular shape, structure, and feature described herein may be embodied in other embodiments without departing from the idea and scope of one aspect of the present disclosure in connection with the embodiment. In addition, it shall be understood that the location or arrangement of an individual element within each disclosed embodiment may be modified without departing from the idea and scope of one aspect of the present disclosure.

Accordingly, the following detailed description does not disclose a limited meaning, and the scope of the present disclosure is limited only by the appended claims, along with the full scope of equivalents to which the claims are entitled, if properly explained. Similar reference numerals in the drawings refer to the same or similar function throughout several aspects.

Although general terms which are widely used recently have been selected in one aspect of the present disclosure while taking into consideration the function according to one aspect of the present disclosure as possible, the terms may vary depending on the intention of those skilled in the art, judicial cases, the advent of new technology, or the like. In addition, in certain cases, the terms may be arbitrarily selected by the applicant. In this case, the meaning thereof will be described in detail in the relevant description of the present disclosure. Accordingly, the terms used in one aspect of the present disclosure should be defined based on the meaning of the term and contents throughout one aspect of the present disclosure, not simply on names of the terms.

When one part "includes" one element in one aspect of the present disclosure, the above expression does not exclude other elements, but may further include the other elements, unless particularly stated otherwise.

The container for mixing heterogeneous contents according to one aspect of the present disclosure will be described with reference to FIGS. 1 to 7.

Figure 2:
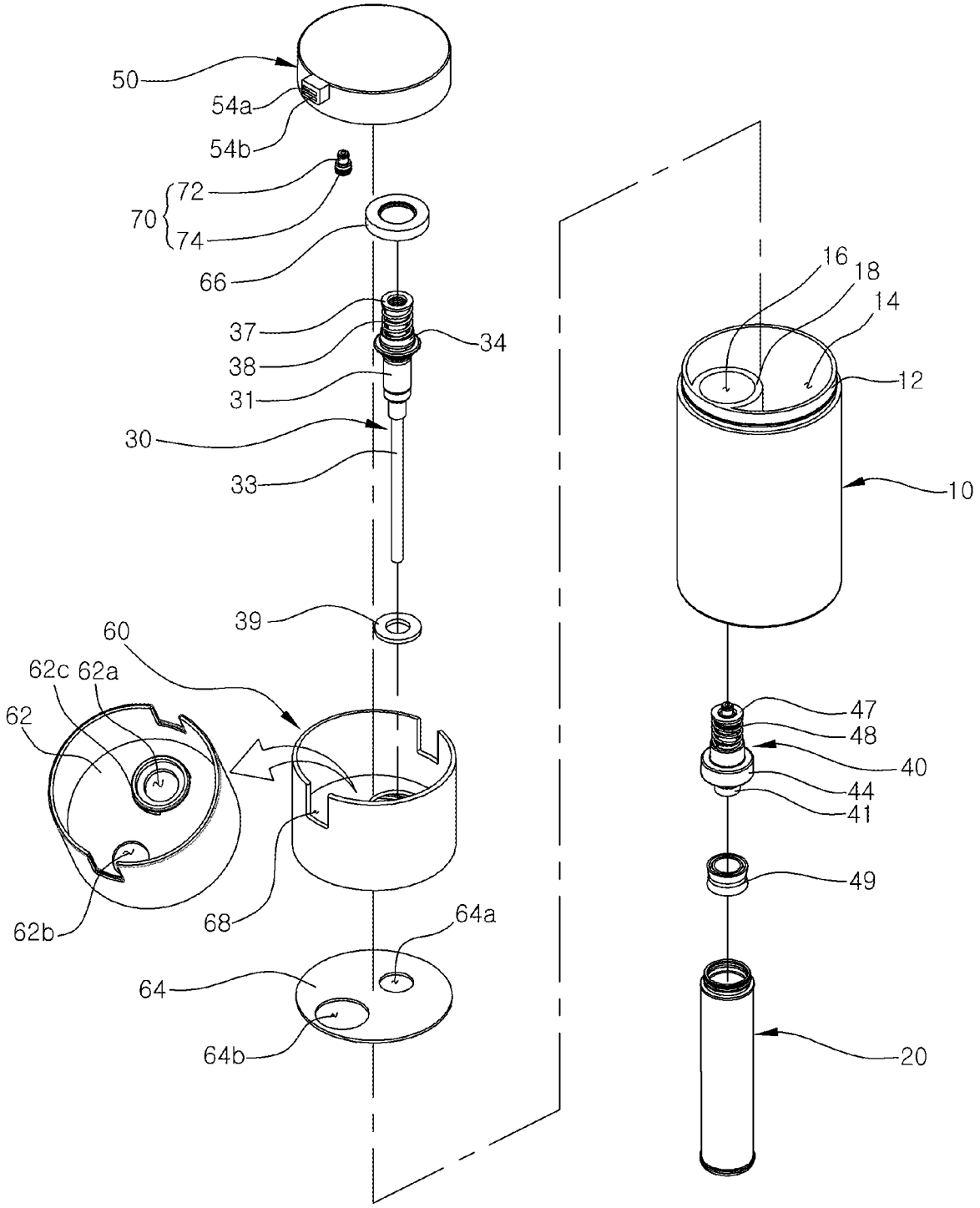
FIG. 2 is an exploded perspective view of the mixing container according to one aspect of the present disclosure.
Figure 3:
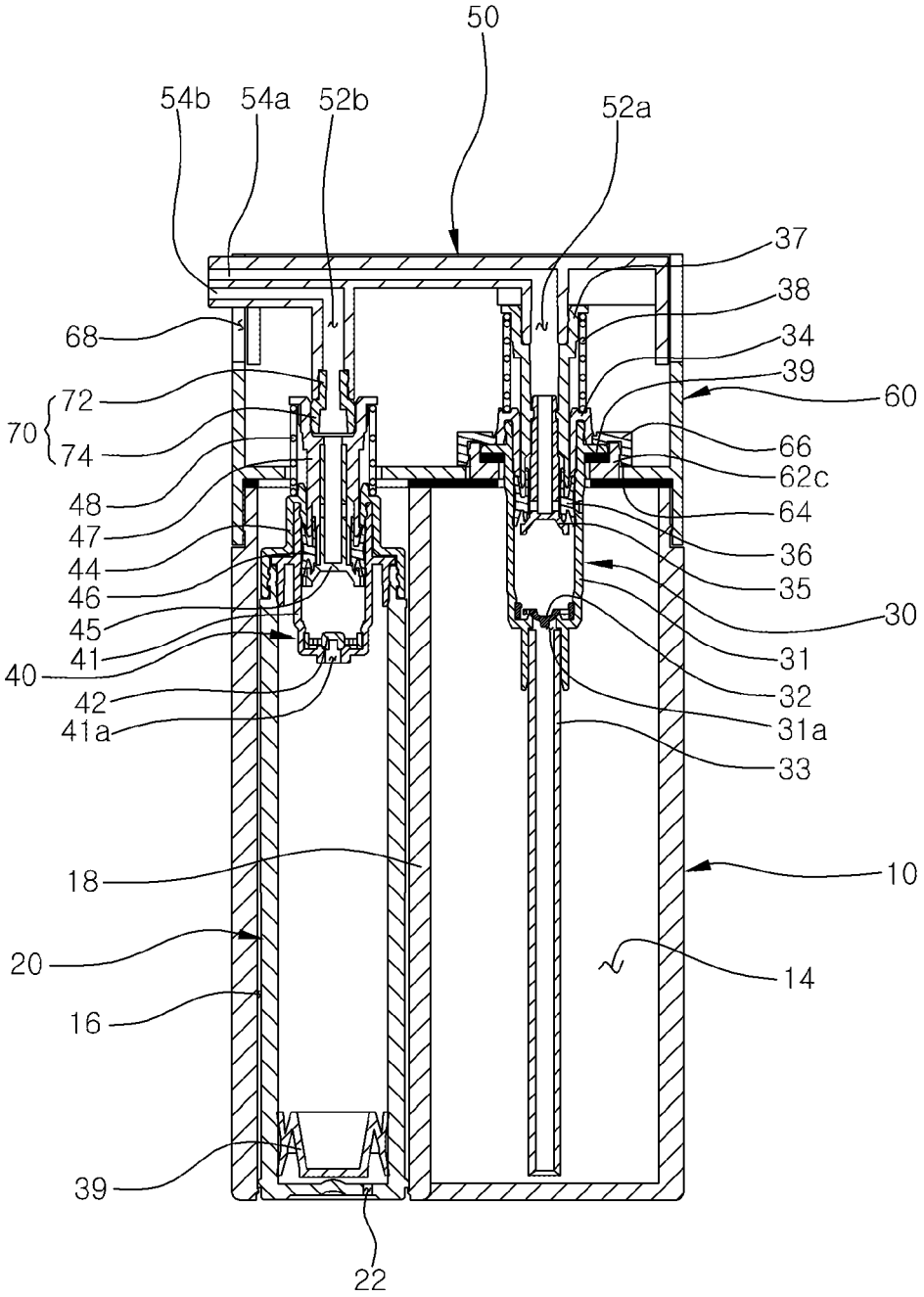
FIG. 3 is a sectional view of the mixing container according to one aspect of the present disclosure.

FIG. 1 is a perspective view of the mixing container according to one aspect of the present disclosure. FIG. 2 is an exploded perspective view of the mixing container according to one aspect of the present disclosure. FIG. 3 is a sectional view of the mixing container according to one aspect of the present disclosure.

As shown in the drawing, the mixing container according to one aspect of the present disclosure may include a first container 10, a second container 20, a first discharge device 30, a second discharge device 40, and a push button 50.

The first container 10 may accommodate liquid-type or gel-type first contents C1 therein and may be formed at one side thereof with an opened inlet portion 12.

As shown in FIG. 1, the first container 10 may be formed of a rigid material to maintain a basic shape. Although the first container 10 is illustrated in a rigid cylindrical shape in the drawings of the mixing container according to an aspect of the present disclosure, the first container 10 may not be limited thereto, and may be formed in various shapes and formed of various materials.

As shown in FIGS. 2 and 3, the first container 10 may be formed therein with a content storage space 14 and a container coupling space 16.

The content storage space 14 and the container coupling space 16 may be divided while being separated from each other by a partition wall 18, in which at least a portion of the partition wall 18 may have a partially cylindrical shape connected to the inner periphery of the first container 10.

In addition, first contents C1 may be stored in the content storage space 14, and the second container 20 may be detachably coupled to the container coupling space 16. The container coupling space 16 may have opened upper and lower portions, in which the second discharge device 40 may pass through the opened upper portion, and the second container 20 provided with the second discharge device 40 may be inserted into the opened lower portion.

Meanwhile, a cap member 60 may be further coupled to the first container 10. An inlet portion 12 of the first container 10 may be fixedly coupled to one side of the cap member 60, and the push button 50 may be coupled to the other side of the cap member 60 such that the push button 50 can move vertically.

A support plate 62 may be formed inside the cap member 60. A discharge device installation hole 62*a* may be formed in the support plate 62 so that the first discharge device may be installed, and a discharge device through hole 62*b* may be formed in the support plate 62 so that the second discharge device 40 installed in the second container 20 may pass through the discharge device through hole 62*b* when the second container 20 is coupled to the lower portion of the first container 10.

In addition, an upper extension protrusion ring 62*c* may extend upward along the outer circumference of the discharge device installation hole 62*a* on an upper surface of the support plate 62. The first discharge device 30 may be inserted into the upper extension protrusion ring 62*c* to prevent the first discharge device 30 from being moved. The upper extension protrusion ring 62*c* may be formed separately from the support plate 62 and may be coupled to the support plate 62.

In addition, a sealing plate 64 formed of an elastic material may be provided under the support plate 62 of the cap member 60 to seal between the first container 10 and the cap member 60. The sealing plate 64 may be formed with a first through hole 64*a* corresponding to the discharge device installation hole 62*a* of the support plate 62, and a second through hole 64*b* corresponding to the discharge device through hole 62*b* of the support plate 62.

Further, an 'L'-shaped fixing ring 66 may be provided at an upper portion of the support plate 62 adjacent to the discharge device installation hole 62*a* in order to fix the first discharge device 30 to the support plate 62, and a discharge port exposure hole 68 may be formed at one side of the upper portion of the cap member 60 in order to expose first and second discharge ports 54*a* and 54*b* of the push button 50 to the outside.

The second container 20 may be coupled to the container coupling space 16 of the first container 10. Accordingly, the second container 20 may be formed in a cylindrical shape corresponding to the container coupling space 16 of the first container 10.

As shown in FIGS. 2 and 3, the second container 20 may be located while being biased in one side from the center of the first container 10, and preferably, the second container 20 may be located below a horizontal extension line of the first and second discharge passages of the push button 50 to be described below.

Second contents C2 may be stored in the second container 20. The second contents C2 are different from the first contents C1, and may increase the efficacy or effect when used in combination with the first contents C1.

The second discharge device 40 for discharging the contents stored in the second container 20 to the outside may be installed at one side of the second container 20, and the second discharge device 40 may be inserted into a lower portion of the container coupling space 16 of the first container 10 (16) and fixedly coupled to the inside of the first container 10. In addition, an air circulation hole 22 may be formed in a bottom surface of the second container 20 to allow external air to be introduced into the second container 20 whenever the second discharge device 40 is operated.

That is, since a conventional mixing container has a structure in which an entire inner container is inserted into an inlet portion of an opened outer container and accommodated therein together with the cosmetic contents stored in the outer container, external foreign substances sticking on the outer periphery of the inner container may enter the outer container and contaminate the cosmetic contents stored in the outer container in the process of assembling or disassembling the inner container and the outer container. In addition, due to the volume of the inner container or sudden insertion, the contents stored in the outer container may overflow to the outside and contaminate the surroundings.

In order to solve the above problem, as shown in FIG. 3, the mixing container according to an aspect of the present disclosure divides the inner space of the first container 10 to separately form the content storage space 14 where the contents are stored and the container coupling space 16 where the second container 20 is mounted. In use, the second container 20 is inserted into the opened lower portion of the container coupling space 16 such that the second container 20 can be coupled with the first container 10, and at the same time, the second discharge device 40 installed in the second container 20 is connected to the second discharge passage 52*b*, so that the second container 20 coupled to the first container 10 does not affect the first contents C1. Therefore, the first container 10 can be more conveniently coupled with the second container 20, and the first contents C1 can be prevented from being contaminated by external foreign substances in the process of coupling the second container 20.

Although the first container 10 is shown as being undercut-coupled to the second container 20 in the drawing of the mixing container according to one aspect of the present disclosure, the present disclosure is not limited thereto, and various coupling schemes, such as protrusion-and-groove coupling, press fitting coupling, or screw coupling may be applicable.

The first discharge device 30 may be installed on the support plate 62 of the cap member 60 in a state in which at least a part of the first discharge device 30 is inserted into the first container 10, and discharge the first contents C1 stored in the first container 10 to the outside. The first discharge device 30 may be a pump configured to discharge a fixed amount of the contents to the outside by a pumping action.

As shown in FIG. 3, the first discharge device 30 may include a first housing 31 formed at one side thereof with a first contents suction hole 31*a*, a first suction valve 32 configured to open and close the first contents suction hole 31*a* of the first housing 31, a first suction tube 33 coupled to a lower portion of the first housing 31 to suck the first contents C1 into the first housing 31, a first housing cap 34 fixedly coupled to an upper portion of the first housing 31, a first piston support 35 formed inside the first housing 31 to vertically move inside the first housing 31, a first piston 36 fitted to an outer side of the first piston support 35 to come into close contact with an inner surface of the first housing 31, a first stem 37 coupled to an upper portion of the first piston support 35, and a first spring 38 configured to elastically support the first stem 37.

In addition, a sealing ring 39 may be further provided between a first housing 31 of the first discharge device 30 and the support plate 62 of the cap member 60 in order to improve the sealing force inside the first container 10.

The second discharge device 40 may be fixedly installed in the second container 20 in a state in which at least a part of the second discharge device 40 is inserted into the second container 20 and the second discharge device 40 may be inserted into the first container 10 together with the second container 20. The second discharge device 40 may discharge the second contents C2 stored in the second container 20 to the outside. The second discharge device 40 may be a pump that discharges a fixed amount of contents to the outside by a pumping action.

As shown in FIG. 3, the second discharge device 40 may include a second housing 41 formed at one side thereof with a second contents suction hole 41*a*, a second suction valve 42 configured to open and close the second contents suction hole 41*a* of the second housing 41, a second housing cap 44 coupled to an upper portion of the second housing 41 to fix the second housing to one side of the second container 20, a second piston support 45 formed inside the second housing 41 to vertically move inside the second housing 41, a second piston 46 fitted to an outer side of the second piston support 55 to come into close contact with an inner surface of the second housing 41, a second stem 47 coupled to an upper portion of the second piston support 45, a second spring 48 configured to elastically support the second stem 47, and a second push plate 49 configured to push up the second contents C2 toward the second housing 41 corresponding to an amount of the second contents C2 discharged from the inside of the second container 20.

Meanwhile, the first discharge device 30 and the second discharge device 40 may have a size and a structure different from each other according to the using ratio between the first and second contents C1 and C2 to be pumped. For example, when the first contents C1 discharged by the first discharge device 30 are configured to be discharged, mixed and used more than the second contents C1 discharged by the second discharge device 40, a piston stroke distance and a cylinder inner diameter of the first discharge device 30 may be greater than those of the second discharge device 40.

The push button 50 may be coupled to the cap member 60 so as to move up and down to simultaneously actuate the first and second discharge device 30 and 40, when pressed by a press action of the user.

First and second discharge passages 52*a* and 52*b* connected to the first and second discharge device 30 and 40 may be formed inside the push button 50, respectively, and first and second discharge ports 54*a* and 54*b* may be formed at one end portions of the push button 50 exposed to the outside of the first and second discharge passages 52*a* and 52*b*, respectively.

The first discharge passage 52*a* of the push button 50 may be coupled to the first stem 37 of the first discharge device 30 to allow the first contents C1 pumped by the first discharge device 30 to move to the first discharge port 54*a*, and the second discharge passage 52*b* may be coupled to the second stem 47 of the second discharge device 30 to allow the second contents C2 pumped by the second discharge device 40 to move to the second discharge port 52*b*.

In addition, a soft sealing member 70 may be formed at an end of the second discharge passage 52*b*, that is, at a position opposite to the second discharge port 54*b*. The sealing member 70 may be fitted with the second discharge device 40 installed in the second container 20 when the first container 10 is coupled with the second container 20, thereby stably sealing the inside of the second container 20 and the second discharge device 40.

In other words, the sealing member 70 may have a tubular shape with opened upper and lower portions, and may include a coupling portion 72 coupled to the second discharge passage 52*b* and a sealing insertion portion 74 inserted into an upper portion of the second discharge device 40. The coupling portion 72 may be inserted into the end of the second discharge passage 52*b* and fixedly coupled thereto, and the sealing insertion portion 74 may be tightly fitted into an upper inner periphery of the second stem 47 of the second discharge device 40.

The sealing member 70 may be formed of a soft material to improve the sealing force inside the second container and to be smoothly inserted into the inside of the second step 47 of the second discharge device 40. The sealing member 70 may be formed of at least one of materials including urethane rubber, natural rubber, elastomer, NBR (nitrile-butadiene rubber) and silicone (silicone), or at least one of elastic materials including polypropylene, polyethylene, acrylonitrile butadiene styrene (ABS), and thermos-plastic elastomer (TPE). The material for the sealing member 70 may not be limited to the above-described materials, and may be formed of various materials so far as they have a predetermined elasticity.

In addition, the first and second discharge ports 54*a* and 54*b* may be formed above and below each other. That is, the second discharge port 54*b* may be positioned very below the first discharge port 54*a*, so that the first contents C1 discharged from the first discharge port 54*a* and the second contents C2 discharged from the second discharge port 54*b* may be mixed and used.

FIGS. 4 to 7 are views illustrating the assembly and use of the container for mixing heterogeneous contents according to one aspect of the present disclosure. The assembly and use of the heterogeneous content mixing container according to one aspect of the present disclosure will be described with reference to the above drawings.

Figure 4:
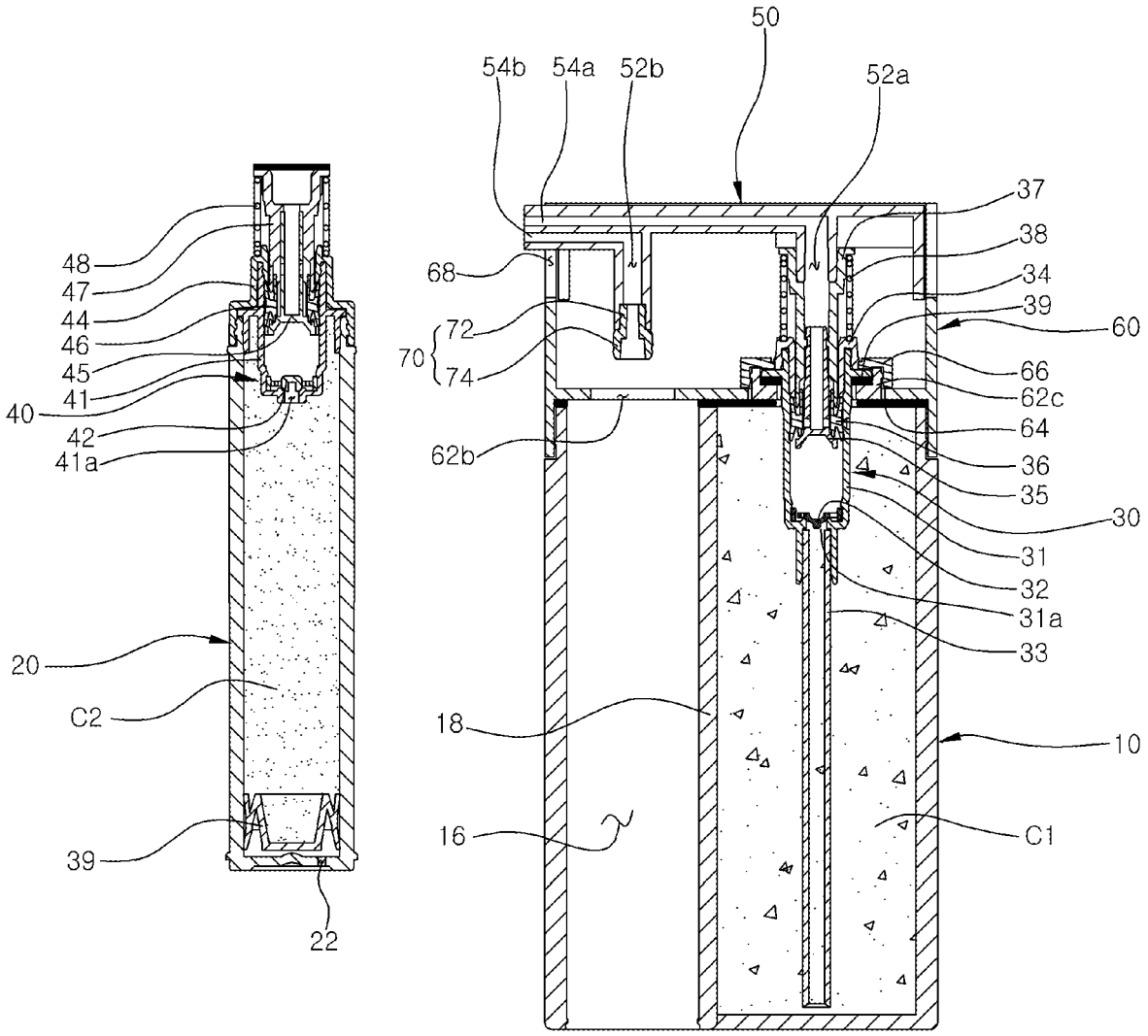
FIG. 4 is a sectional view illustrating a state before a second container is couple to a first container according to one aspect of the present disclosure.
Figure 5:
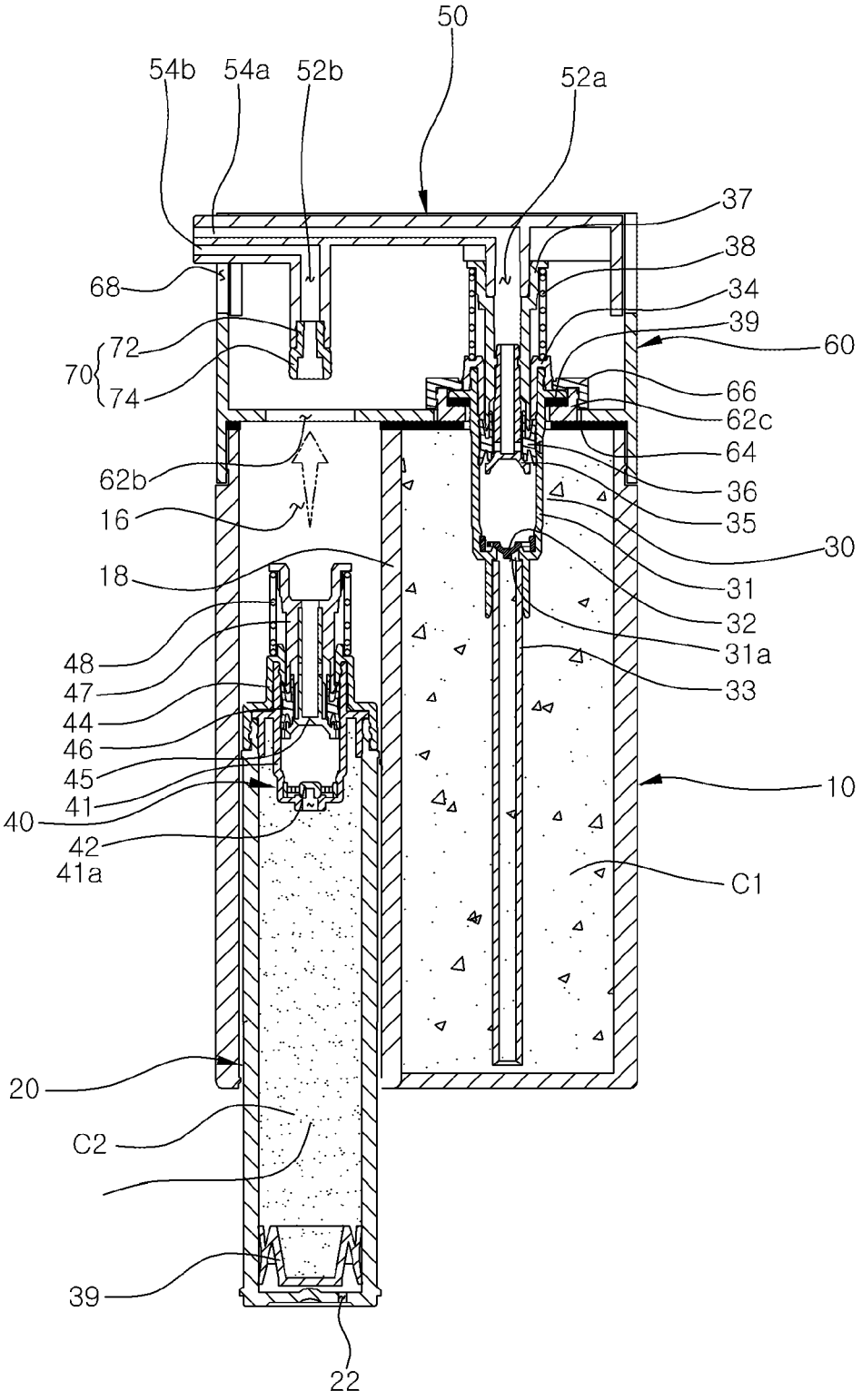
FIG. 5 a sectional view illustrating a state in which the first container is coupled to the second container according to one aspect of the present disclosure.
Figure 6:
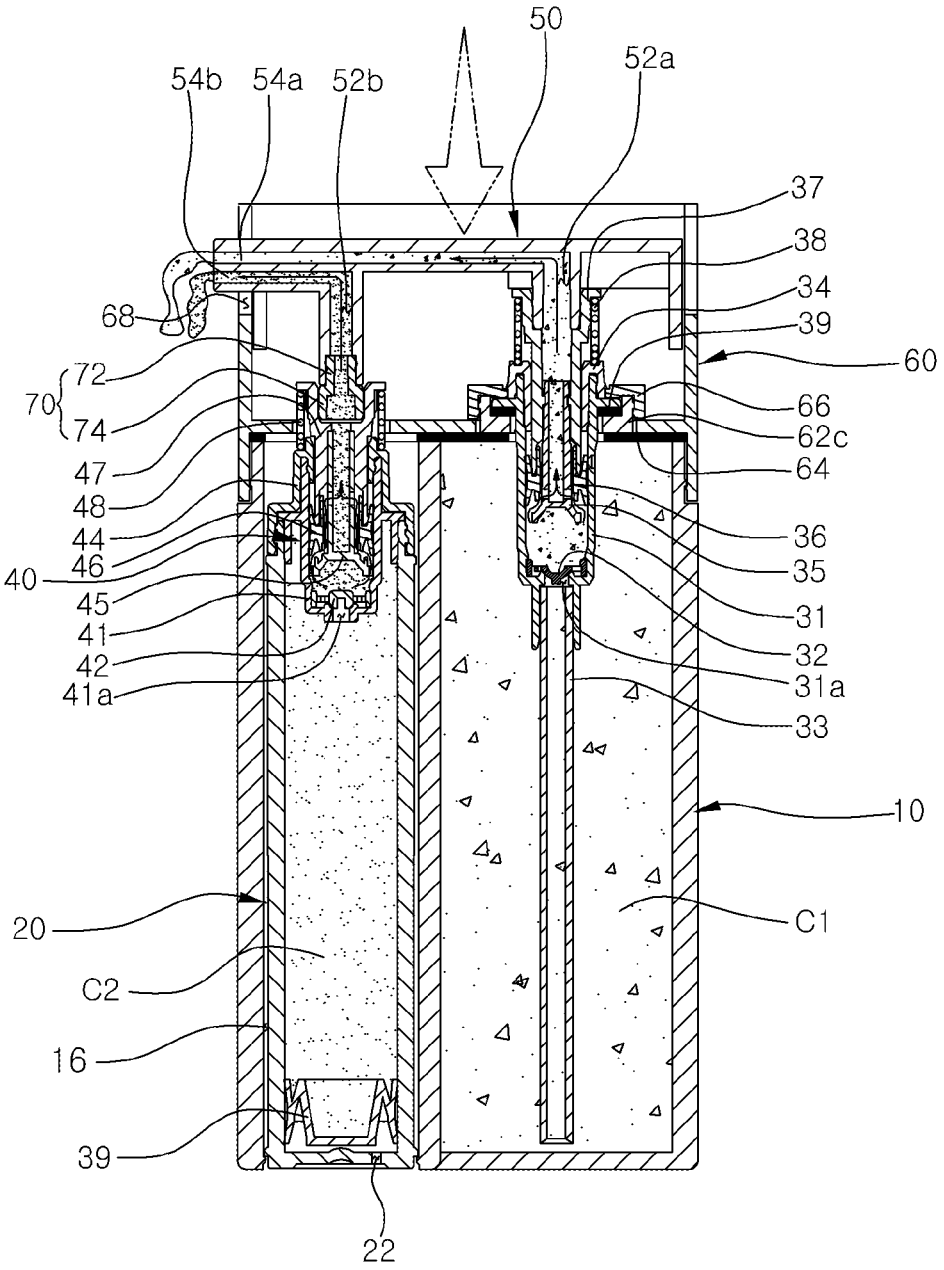
FIG. 6 is a sectional view showing a state in which heterogeneous contents are simultaneously discharged when a push button of the mixing container according to one aspect of the present disclosure is pushed.
Figure 7:
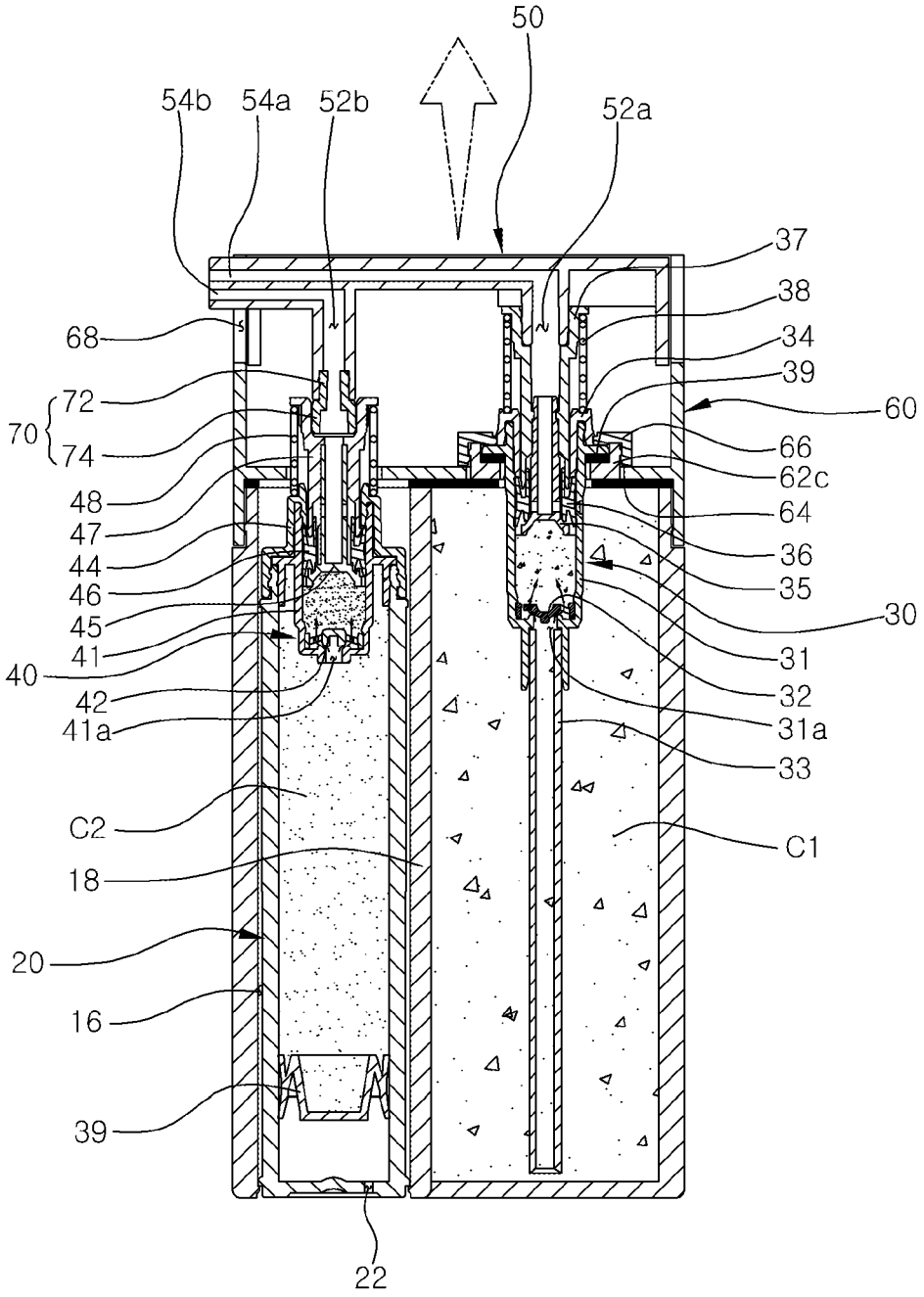
FIG. 7 is a sectional view showing a state in which the contents are introduced into first and second discharge devices while the push button of the mixing container according to one aspect of the present disclosure is restored to an original position.

FIG. 4 is a sectional view illustrating a state before a second container is couple to a first container according to one aspect of the present disclosure, FIG. 5 is a sectional view illustrating a state in which the first container is coupled to the second container according to one aspect of the present disclosure, FIG. 6 is a sectional view illustrating a state in which heterogeneous contents are simultaneously discharged as the push button of the mixing container according to one aspect of the present disclosure is pressed, and FIG. 7 is a sectional view showing a state in which the contents are introduced into the first and second discharge devices while the push button of the mixing container according to one aspect of the present disclosure is restored to an original position.

First, in order to assemble the mixing container according to one aspect of the present disclosure, as shown in the drawings, liquid-type or gel-type first contents C1 are filled in the content storage space 14 of the first container 10.

Then, the first discharge device 30, which includes the first housing 31, the first suction valve 32, the first suction tube 33, and the first housing cap 34, the first piston support 35, the first piston 36, the first stem 37, and the first spring 38, is installed in the discharge device installation hole 62*a* of the cap member 60, and the first discharge device 30 is fixed by coupling a fixing ring 66 to the upper extension protrusion ring 62*c* of the support plate 62.

Next, the cap member 60 is coupled to the inlet portion 12 of the first container 10, and the push button 50 is coupled to the opened upper portion of the cap member 60 so as to move up and down. In this case, the end of the first discharge passage 52*a* of the push button 50 is coupled to the first stem 37 of the first discharge device 30, and the soft sealing member 70 is coupled to the end of the second discharge passage 52*b*.

After that, the push plate 49 is placed on an inner bottom of the second container and the liquid-type or gel-type first contents C1 are filled. Then, the second discharge device including the housing 41, the second suction valve 42, the second housing cap 44, the second piston support 45, the second piston 46, the second stem 47 and the second spring 48 is installed.

Next, as shown in FIG. 4, the first container 10 and the second container 20 assembled in the above-described manner are separately packaged. In this case, the end portion of the second discharge device 40 installed in the second container 20 is sealed, so that foreign substances may be prevented from permeating into the second discharge device 40 during distribution or storage.

Meanwhile, when the mixing container assembled in the above-described manner is used, as shown in FIG. 5, the second container 20 is inserted into the lower portion of the container coupling space 16 of the first container 10 so that the second container 20 is coupled with the first container 10. In this case, the second discharge device 40 installed in the second container 20 passes through the discharge device through hole 62*b* of the cap member 60 by way of the container coupling space 16 of the first container 10 and the first container 10 is fixedly coupled with the second container 20. Thus, the sealing member 70 is tightly fitted into the second step 47 of the second discharge device 40. Accordingly, the first contents C1 stored in the first container 10 and the second contents C2 stored in the second container 20 can be discharged together through the first and second discharge device 30 and 40.

Then, as shown in FIG. 6, the first contents C1 stored in the first container 10 and the second contents C2 stored in the second container 20 are discharged together by simultaneously pressing the first discharge device 30 and the second discharge device 40 using the push button 50, and thus the heterogeneous contents discharged in the above manner are mixed and used.

More specifically, when the first and second discharge device 30 and 40 are pressed together, the first and second stems 37 and 47 and the first and second piston supports 35 and 45 coupled to lower portions of the first and second stems 37 and 47 move downward. Since the first and second pistons 36 and 46 of the first and second discharge device 30 and 40 come into close contact with inner surfaces of the first and second housings 31 and 41, only the first and second piston supports 35 and 45 move downward, thereby generating gaps between the first and second piston supports 35 and 45 and the first and second pistons 36 and 46, and thus discharge passages of the first and second contents C1 and C2 are generated.

Then, the lower ends of the first and second stems 37 and 47, which are moving downward, press the first and second pistons 36 and 46, so that the first and second pistons 36 and 46 move downward together with the first and second piston supports 35 and 45, thereby reducing volumes inside the first and second housings 31 and 41. Accordingly, the first and second suction valves 32 and 42 block the first and second contents suction ports 31*a* and 41*a* due to discharge pressures in the first and second housings 31 and 41, and the first and second contents C1 and C2 accommodated in the first and second housings 31 and 41 come out between the first and second piston supports 35 and 45 and the first and second pistons 36 and 46, pass through the inside of the first and second piston supports 35 and 45 and the first and second discharge passages 52*a* and 52*b*, and are discharged to the first and second discharge ports 54*a* and 54*b*, respectively.

Then, as shown in FIG. 7, when the pressure applied to the push button 50 is released, the first and second stems 37 and 47 and the first and second piston supports 35 and 45 coupled to the lower portions of the first and second stems 37 and 47 move upward due to the elasticities of the first and second springs 38 and 48 for elastically supporting the first and second stems 37 and 47. In this case, the lower portions of the first and second piston supports 35 and 45 pull up the first and second pistons 36 and 46, thereby closing the gaps between the first and second piston supports 35 and 45 and the first and second pistons 36 and 46, so that the first and second piston supports 35 and 45 upwardly move together with the first and second pistons 36 and 46.

Accordingly, vacuum pressures are generated due to increases of volumes inside the first and second housings 31 and 41, and the first and second suction valves 32 and 42 are lifted up by the vacuum pressure, thereby opening the first and second contents suction ports 31*a* and 41*a*, so that the first and second contents C1 and C2 stored in the first and second containers 10 and 20 are introduced into the first and second housings 31 and 41, respectively. Simultaneously, the push plate 49 provided inside the second container 20 moves upward corresponding to the amount of discharged second contents C2.

Then, the heterogeneous contents discharged in the above manner are mixed and used.

Although the present disclosure has been described with the particulars such as specific elements, the limited embodiments, and the drawings, it is obvious that the particulars are provided only to help comprehensive understanding of the present disclosure, the present disclosure is not limited to the embodiments, and various changes and modifications may be carried out by those skilled in the art.

Therefore, the spirit of the present disclosure should not be limited to the aforementioned embodiments, and the following claims as well as all modifications or variations belonging to the equivalents of the claims will be within the scope of the present disclosure.

What is claimed is:

1. A container for mixing heterogeneous contents, the container comprising:

a first container formed therein with a content storage space and a container coupling space, which are separately defined;

a second container coupled to the container coupling space of the first container;

a first discharge device installed in the first container to discharge contents stored in the first container;

a second discharge device installed in the second container to discharge contents stored in the second container; and a push button configured to simultaneously actuate the first and second discharge devices and formed with first and second discharge passages connected to the first and second discharge devices, respectively, and first and second discharge ports, wherein the second container is inserted into an opened lower portion of the container coupling space so that the second container is coupled with the first container, and the second discharge device installed in the second container is connected to the second discharge passage.

2. The container of claim 1, further comprising a cap member provided at an inner side thereof with a support plate and coupled to the first container, wherein the support plate is formed with a discharge device installation hole to install the first discharge device and a discharge device through hole in which the second discharge device passes through the discharge device through hole.

3. The container of claim 1, wherein the second container is biased to one side from a center of the first container.

4. The container of claim 1, wherein the first and second discharge devices include pumps for discharging the contents to an outside by pumping.

5. The container of claim 1, wherein a soft sealing member is formed at an end of the second discharge passage of the push button, and the second discharge device installed in the second container is fitted with the soft sealing member when the first container is coupled with the second container.

6. The container of claim 5, wherein the soft sealing member includes a coupling portion coupled to the second discharge passage and a sealing insert portion inserted into a second stem of the second discharge device.

* * * * *